US005720642A

United States Patent [19]

Hattori

[11] Patent Number: 5,720,642

[45] Date of Patent: Feb. 24, 1998

[54] MANUFACTURE OF ELECTRON EMITTER UTILIZING REACTION FILM

[75] Inventor: Atsuo Hattori, Hamamatsu, Japan

[73] Assignee: Yamaha Corporation, Japan

[21] Appl. No.: 709,514

[22] Filed: Sep. 6, 1996

[30] Foreign Application Priority Data

Sep. 8, 1995 [JP] Japan ..... 7-257150

[51] Int. Cl.[6] ..... H01J 1/30; H01J 9/02

[52] U.S. Cl. ..... 445/50; 445/24

[58] Field of Search ..... 445/24, 50

[56] References Cited

U.S. PATENT DOCUMENTS

| | | | |
|---|---|---|---|
| 5,100,355 | 3/1992 | Marcus et al. | 445/24 |
| 5,141,459 | 8/1992 | Zimmerman | 445/24 |
| 5,203,731 | 4/1993 | Zimmerman | 445/24 |
| 5,334,908 | 8/1994 | Zimmerman | 313/336 |
| 5,599,749 | 2/1997 | Hattori | 445/24 |
| 5,603,649 | 2/1997 | Zimmerman | 445/24 |
| 5,643,032 | 7/1997 | Cheng et al. | 445/50 |

FOREIGN PATENT DOCUMENTS 5-174703 7/1993 Japan .

*Primary Examiner*—P. Austin Bradley
*Assistant Examiner*—Jeffrey T. Knapp
*Attorney, Agent, or Firm*—Ostrolenk, Faber, Gerb & Soffen, LLP

[57] ABSTRACT

A first recess having a vertical or generally vertical side wall is formed in a surface layer of a substrate. A polysilicon film as a gate electrode material film is deposited on the substrate by film deposition process with poor step coverage. The polysilicon film is oxidized to leave the polysilicon film only outside of the first recess and form a silicon oxide film having a second recess with a sharp edge over the first recess. An emitter electrode material film is formed on the silicon oxide film, filling the second recess with a field emission emitter. An opening is formed in the emitter electrode material film to etch and remove the silicon oxide films around and under the field emission emitter. A field emission emitter having a tip with a small radius of curvature and a small apex angle can be manufactured in self-alignment with a gate opening, with simple processes, with good controllability, to provide high electric performance.

13 Claims, 7 Drawing Sheets

MANUFACTURE OF ELECTRON EMITTER UTILIZING REACTION FILM

BACKGROUND OF THE INVENTION

1. Field of the Invention

The present invention relates to a manufacture method of a field emission element with a gate electrode, and more particularly to a field emission element having a field emission emitter self-aligned with a gate opening.

2. Description of the Related Art

Such vacuum microdevice technologies using fine pattern fabrication technologies of semiconductor integrated circuits have recently been attracting attentions, that technologies are used for manufacture of fine cold cathode electron sources and applied to ultra-fine amplification devices, integrated circuits, flat displays, and the like. For practical vacuum microdevices, it is essential to develop cold cathode electron sources capable of stably emitting electrons under the influence of electrical field at a low voltage. Cold cathode electron sources are roughly classified into two types, i.e., field emission type elements which emit electrons from a sharp edge of an emitter by the help of a concentrated electric field, and the other type elements which generate high energy electrons in semiconductor through avalanche or the like and taking them out to the external. A field emission emitter structure includes a vertical emitter whose needle-like sharp tip is formed perpendicular to the substrate surface, and a lateral emitter whose tip is formed planar along the substrate surface.

In order to form a vertical type field emission emitter, it is preferable to form an emitter mold having a sharp cusp. The methods of forming a field emission emitter are mainly classified into (1) using sacrificial film deposition, (2) using a reactive film, and (3) using anisotropic etching.

For an integrated field emission type element array, it is necessary to form fine field emission emitters in a matrix shape and at the same time integrally form gate electrodes for driving field emission emitters. One of typical methods conventionally proposed for manufacturing such field emission type elements with gate electrodes is disclosed, for example, in U.S. Pat. No. 5,203,731 in which a gate electrode material film is deposited on a substrate and selectively etched to form a recess (gate opening), an insulating film is deposited on the gate electrode material film by a film forming process with good step coverage, the insulating film having at its surface a sharp cusp which serves as an emitter mold, and finally an emitter electrode material is deposited on the insulating film. By removing the insulating film in the gate opening and around the emitter tip, an element having a field emission emitter self-aligned with the gate opening can be formed.

Another method has been proposed by which part of gate electrode material is oxidized to form an oxide film which is used as the emitter mold. One example of such a method uses a SIMOX silicon substrate having a silicon oxide film formed at a predetermined depth, taper-etches a silicon layer on the substrate surface to form a gate opening, the silicon layer being used later as a gate electrode, and oxidizes the surface of the silicon layer to form a silicon oxide which is used as the emitter mold (refer to JP-A-5-174703).

With the method of forming an insulating film in a gate opening by film deposition to form an emitter mold, however, it is difficult to optimize the film deposition conditions of forming the emitter mold with a sharp recess. Thick film deposition is generally necessary for forming a good emitter mold so that the distance between the emitter and gate cannot be shortened. It is therefore also difficult to obtain an element capable of an electron emission operation at a low electric field intensity.

In the method of forming a gate opening through taper etching of a gate electrode material layer and partially oxidizing the gate electrode material layer to form an emitter mold, the material of the gate electrode is restricted because this method utilizes etching anisotropy dependent upon crystal orientation. Since the taper angle is preset, the recess shape of the emitter mold obtained through oxidation is restricted by the taper angle and is unanimously determined. It is therefore difficult to obtain an emitter having a tip with a small radius of curvature and a small apex angle.

SUMMARY OF THE INVENTION

It is an object of the present invention to provide a manufacture method of a field emission type element capable of forming a field emission emitter having a tip with a small radius of curvature and a small apex angle in self-alignment with a gate opening, with simple processes and good controllability, and of providing high electric performance.

According to one aspect of the present invention, there is provided a method of manufacturing a field emission type element comprising the steps of: forming a first recess having a vertical or generally vertical side wall in a surface layer of a substrate; forming a gate electrode material film on the substrate covering the first recess; reacting the gate electrode material film with oxidizing or nitriding agent to leave the gate electrode material film only outside of the first recess and form an insulating film having a second recess with a sharp edge over the first recess; forming an emitter electrode material film on the insulating film to fill the second recess with a field emission emitter; and removing the insulating film around the field emission emitter.

The gate electrode material film is formed on the substrate having the first recess, and partially reacted with oxidizing or nitriding agent to obtain an insulating film (reaction film) which is used as the emitter mold. By optimizing the reaction conditions, the gate electrode material film is left only outside of the first recess and is wholly converted to the reaction film in and over the first recess. During this process, the opening end of the first recess is closed by the growing reaction film. In this manner, the emitter mold having the second recess with a sharp edge can be formed on the surface thereof. It is therefore possible to form with simple processes an element having a field emission emitter self-aligned with the gate opening and having a tip with a small radius of curvature and a small apex angle.

Preferably, the gate electrode material film is deposited through film deposition process with poor step coverage to form a partially inverted or downwardly broadening taper area over the first recess.

As the gate electrode material film is deposited through film deposition process with poor step coverage to form a partially inverted or downwardly broadening taper area over the first recess, the gate electrode material film is wholly converted into the reaction film in and over the first recess in a relatively short time and is left only outside of the first recess. An excellent emitter mold can be formed by using a relatively thin reaction film so that an element capable of electron emission at a relatively low emitter-gate voltage can be formed.

As above, with this method capable of easily obtaining an insulating film of an emitter mold by partially reacting the gate electrode material film, it is possible to obtain an element having a field emission emitter whose tip has a small radius of curvature and a small apex angle. When a recess is pre-formed in the substrate, the gate opening can be formed through oxidation or nitridation without processes such as taper etching of the gate electrode material film. Still further, a good emitter mold can be formed using a thinner reaction film, as compared to the emitter mold forming method using film deposition. It is therefore possible to obtain an ultra-fine field emission type element capable of being driven at a relatively low gate voltage.

DETAILED DESCRIPTION OF THE PREFERRED EMBODIMENTS

Embodiments of the invention will be described with reference to the accompanying drawings.

Figure 1A:
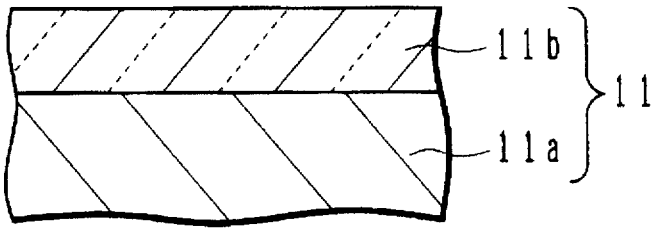
FIGS. 1A to 1G are cross sectional views illustrating manufacture processes of a field emission type element according to an embodiment of the invention.

FIGS. 1A to 1G are cross sectional views illustrating manufacture processes of a field emission type element according to an embodiment of the invention. As shown in FIG. 1A, a substrate 11 is prepared which has an insulating film **11*b*, such as a silicon oxide film and a silicon nitride film, on the surface of a conductive anode electrode plate 11*a*. The anode electrode plate 11*a*** is a silicon substrate for example.

Figure 1B:
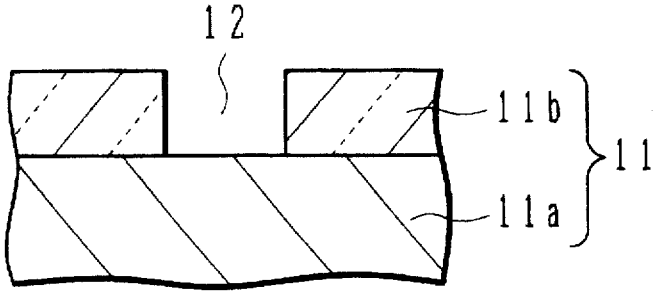

As shown in FIG. 1B, a region of the insulating film **11*b*, where a gate opening is to be formed, is selectively etched by reactive ion etching to form a first recess 12 having a vertical or generally vertical side wall. The size of the first recess 12 is about 0.5 μm in diameter and about 0.3 μm in depth. It is sufficient for the side wall of the first recess 12** if it has an angle allowing the processes illustrated in FIGS. 1C and 1D to be performed.

Figure 1C:
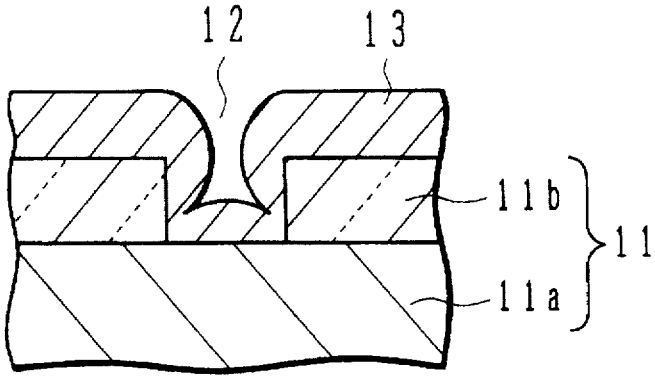

As shown in FIG. 1C, a conductive gate electrode material film 13 is deposited to about 0.2 μm thick on the surface of the substrate 11 having the first recess 12 formed thereon, the gate electrode material film 13 being made of amorphous silicon or polysilicon. The gate electrode material (polysilicon) film 13 is deposited through film deposition having poor step coverage, such as atmospheric pressure (1 atm) CVD, sputtering, and vapor deposition, so that the film 13 has a partially inverted or downwardly broadening taper over the first recess 12, i.e., it has an overhang. A thickness of the film 13 deposited on the bottom surface of the first recess 12 is thinner than that of the film 13 deposited on the top flat surface of the insulating film 12. When the film 13 is silicon, e.g. polysilicon or amorphous silicon, it is diffused with impurities such as phosphor, arsenic, and boron. This impurity diffusion can be omitted if silicide or metal is used as the gate electrode material layer 13, instead of a silicon film.

Figure 1D:
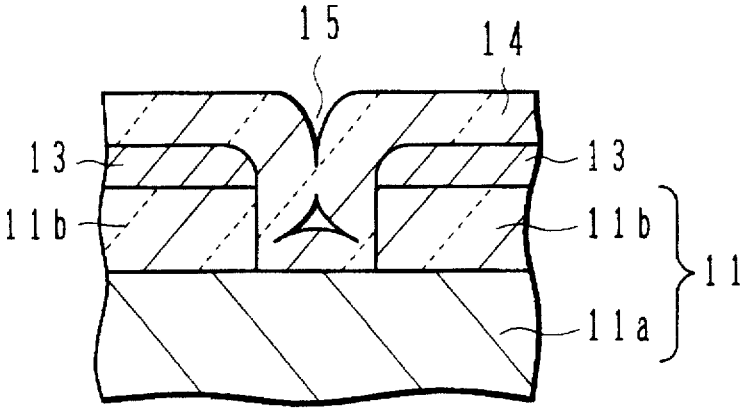

As shown in FIG. 1D, the surface of the gate electrode material (silicon) film 13 is oxidized to form a silicon oxide film 14. Oxidation of a silicon film, e.g. amorphous or polycrystalline silicon, may be performed by wet oxidation, dry oxidation, plasma oxidation, or the like. For wet oxidation, the substrate is placed in a vertical furnace and oxidized at a furnace temperature of 850° C. by introducing $H_2$ (30 l/min) and $O_2$ (20 l/min). The upper portion of the silicon oxide film changed from polysilicon becomes contiguous at the opening end of the first recess 12, and a cusp is formed at this area. The polysilicon film 13 is left only on the flat top surface of the insulating film **11*b* outside of the first recess 12, and at the region in and over the first recess 12 all the polysilicon film 13 is changed to the silicon oxide film 14. Since the polysilicon film 13 is deposited by film deposition process having poor step coverage, the thickness of the film is thinner at the side wall and bottom of the first recess 12 than at the flat top surface of the insulating film 11*b*. Therefore, the polysilicon film 13 is all changed to the silicon oxide film 14 at the side wall and bottom of the first recess 12, and left having a predetermined thickness at the flat top surface of the insulating film 13. The remaining polysilicon film forms a gate electrode having an aperture. During this oxidation process, an opening in the first recess 12 is closed by the growing silicon oxide film 14 which becomes an emitter mold having a second recess (cusp) 15** with a sharp edge formed on the surface thereof.

Instead of the silicon oxide film, a silicon nitride film may be formed through thermal nitridation, plasma nitridation, ammonia nitridation, ammonia plasma and fluorine nitridation, optical nitridation with excimer laser, or the like.

Figure 1E:
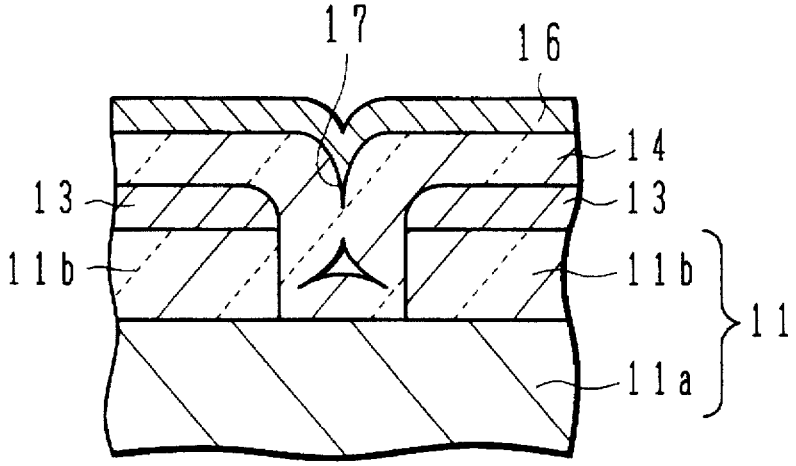

Next, as shown in FIG. 1E, an emitter electrode material film 16 is deposited on the silicon oxide film 14. The emitter electrode material film 16 is, for example, a TiN film of about 0.2 μm thick, which may be formed through reactive sputtering using a Ti target and $N_2$+Ar gas. A field emission emitter (an electron emitting tip) 17 is therefore formed self-aligned with the gate opening and filling the second recess 15 formed on the surface of the silicon oxide film 14.

Figure 1F:
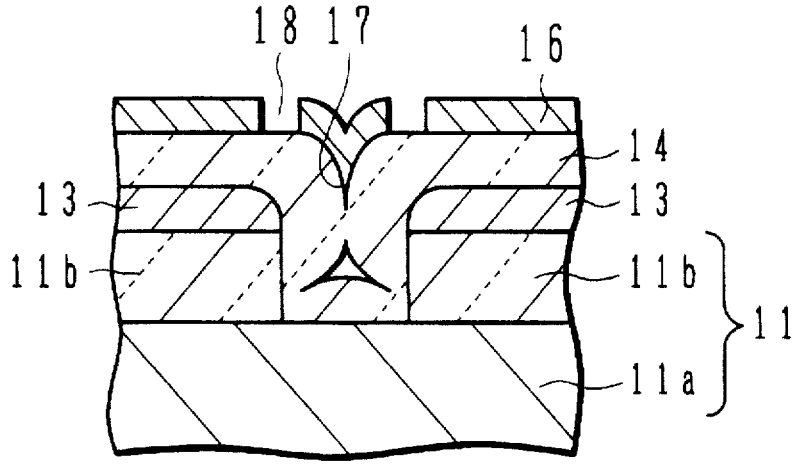
Figure 1G:
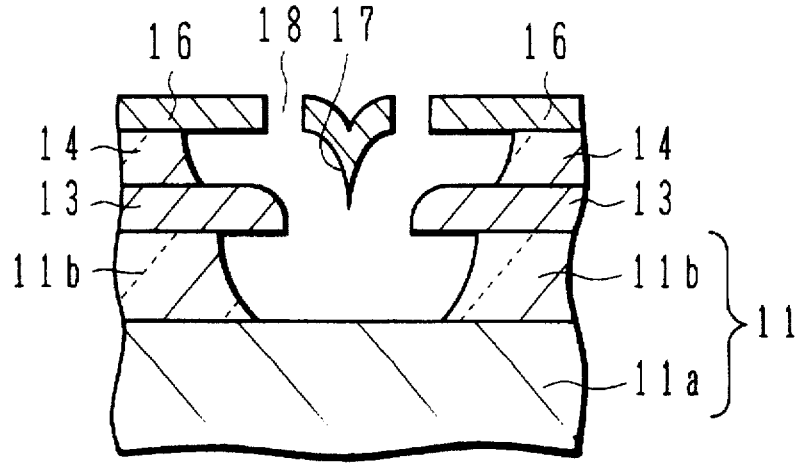

As shown in FIG. 1F, the emitter electrode material film 16 is patterned to form slit openings 18. As shown in FIG. 1G, via the slit openings 18, the silicon oxide film 14 under the field emission emitter 17 is etched and the silicon oxide film **11*b* is also etched by using the gate electrode material film 13 as a mask. This etching is performed by isotropic wet etching using HF+$NH_4F$ gas. The field emission emitter 17** is therefore exposed and a space between the emitter and anode including the gate opening is formed.

Figure 2:
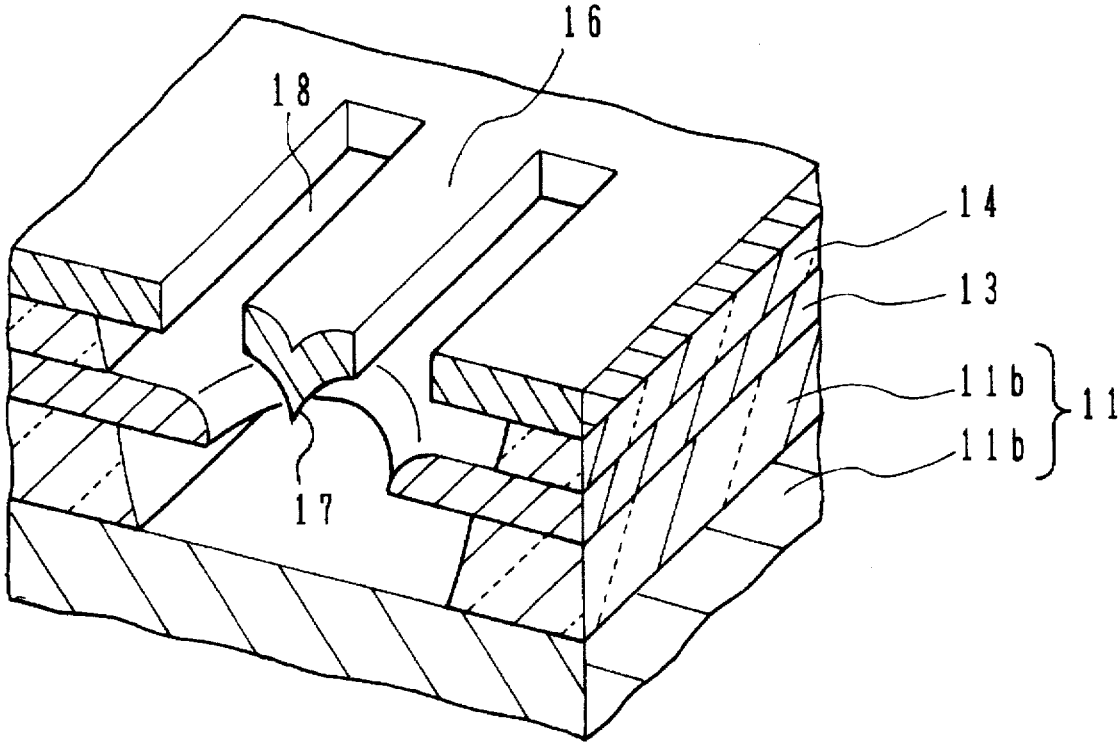
FIG. 2 is a perspective view of the field emission type element shown in FIG. 1G.

FIG. 2 is a perspective view partially broken of a field emission type element manufactured by the above embodiment method. A fine triode tube can be obtained by vacuum sealing a triode element manufactured as above. With this embodiment, it is possible to obtain a field emission type element having a fine field emission emitter integrated and self-aligned with the gate electrode.

With this embodiment method capable of easily obtaining an insulating film of an emitter mold by partially reacting the gate electrode material film, it is possible to obtain an element having a field emission emitter whose tip has a small radius of curvature and a small apex angle. Furthermore, by pre-forming a recess in the substrate, the gate opening can be formed through oxidation or nitridation without processes such as taper etching of the gate electrode material film. Still further, a good emitter mold can be formed using a thin reaction film, which is thinner as compared to the emitter mold forming method using film deposition. It is therefore possible to obtain an ultra-fine field emission type element capable of being driven at a relatively low gate voltage.

In the above embodiment, the material of the anode electrode 11*a* may be, in addition to silicon, other conductors such as semiconductor and metal. The material of the gate electrode film 13 may be, in addition to polysilicon and amorphous silicon, other materials capable of forming an insulating film through reaction, e.g. oxidation or nitridation, including metal silicide, Al, Ti, Ta, Zr, and the like. Oxidation or nitridation may be anodic oxidation, or oxygen or nitrogen ion implantation. The material of the emitter electrode material film 16 may be various types of other metals among which a TiN/W/Al laminate metal structure is particularly effective.

FIGS. 3A to 3E are cross sectional views illustrating the manufacture method of a field emission type element according to another embodiment of the invention.

Figure 3A:
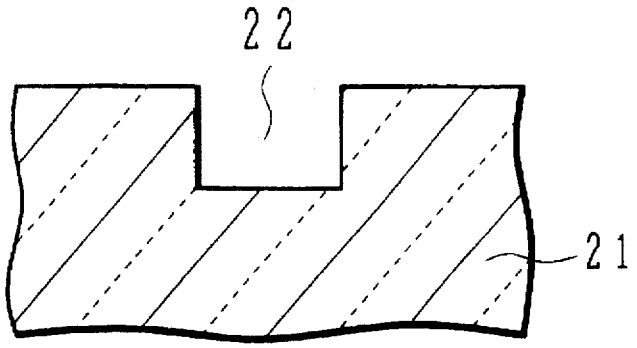
FIGS. 3A to 3E are cross sectional views illustrating manufacture processes of a field emission type element according to another embodiment of the invention.

As shown in FIG. 3A, a first recess 22 having a vertical or generally vertical side wall is formed in the surface layer of an insulating substrate 21.

Figure 3B:
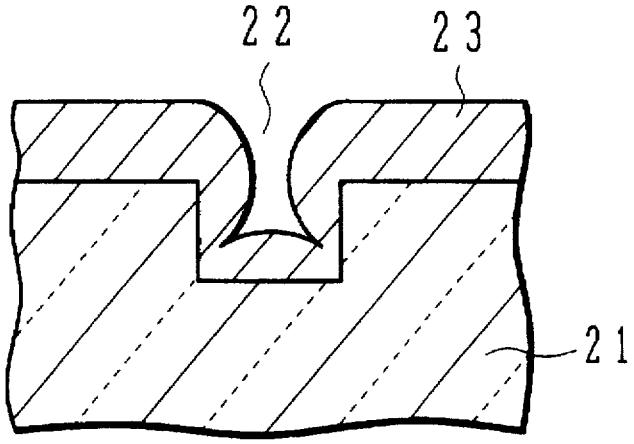

As shown in FIG. 3B, a polysilicon film 23 as a gate electrode material film is deposited on the surface of the substrate 21 having the first recess 22 formed thereon. The insulating substrate 21 may be a silicon substrate having a silicon oxide film formed thereon, similar to the first embodiment. Also in this embodiment, the polysilicon film 23 is deposited through film deposition having poor step coverage, such as normal pressure CVD, sputtering, and vapor deposition, so that the polysilicon film 13 has a partially inverted or downwardly broadening taper over the first recess 22. The polysilicon film 23 is diffused with impurities such as phosphor, arsenic, and boron.

Figure 3C:
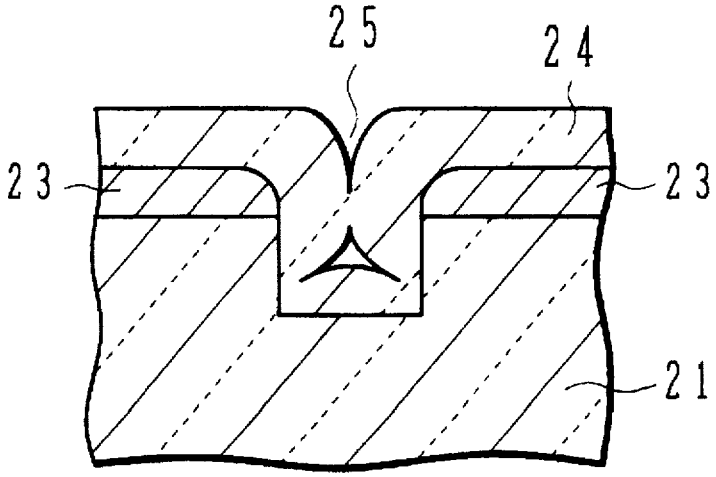

As shown in FIG. 3C, the surface of the polysilicon film 23 is oxidized to form a silicon oxide film 24. Oxidation of the polysilicon film 23 may be performed by wet oxidation, dry oxidation, plasma oxidation, or the like. For wet oxidation, the substrate is placed in a vertical furnace and oxidized at a furnace temperature of 850° C. by introducing $H_2$ (30 l/min) and $O_2$ (20 l/min). Similar to the first embodiment, this silicon oxide film 24 is used as the emitter mold. All the polysilicon film 23 at the first recess 22 is changed to the silicon oxide film 24 which has a second recess (cusp) 25 on the surface thereof with a sharp edge. In place of the silicon oxide film 24, a silicon nitride film may be formed through nitridation.

Figure 3D:
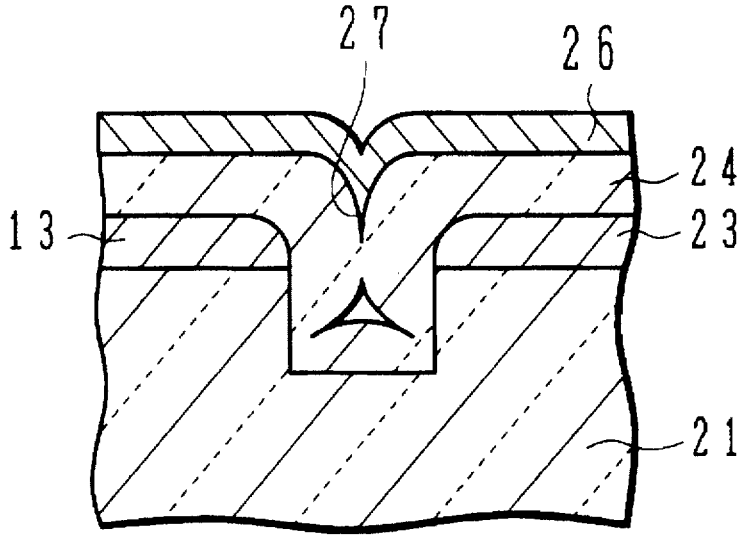
Figure 3E:
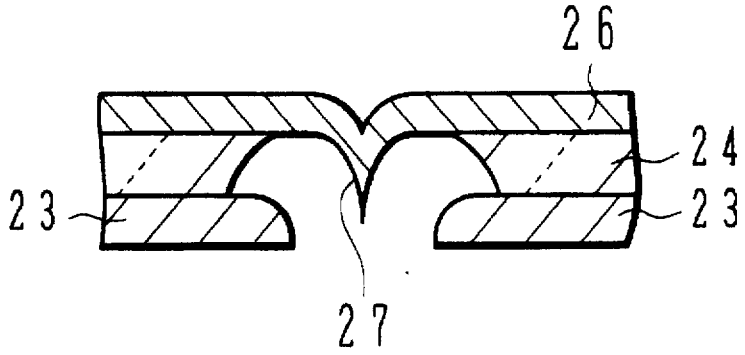

As shown in FIG. 3D, an emitter electrode material film 26 is deposited on the silicon oxide film 24. The emitter electrode material film 26 is, for example, a TiN film of about 0.2 μm thick, which may be formed with a DC sputtering using a Ti target and $N_2$+Ar gas. A field emission emitter 27 is therefore formed having a sharp tip and filling the second recess 25.

Lastly, the substrate 21 is etched and removed. If the insulating substrate 21 is a silicon oxide film, it is removed through wet etching using HF+$NH_4F$, whereas if the insulating substrate 21 is a silicon nitride, it is removed by using hot phosphoric acid. The silicon oxide film 24 exposed in the gate opening is further etched through isotropic etching using HF+$NH_4F$, by using the polysilicon film 23 as a mask. The tip of the field emission emitter 27 is therefore exposed.

In this embodiment, a field emission type element with the gate electrode and without an anode can be manufactured. Also with this embodiment, a ultra-fine and high quality field emission type element can be formed because of the same reasons as the first embodiment.

In the above embodiment, in order to impart a sufficient mechanical strength to the field emission emitter, it is preferable to reinforce the field emission emitter prior to etching and removing the substrate.

Figure 4:
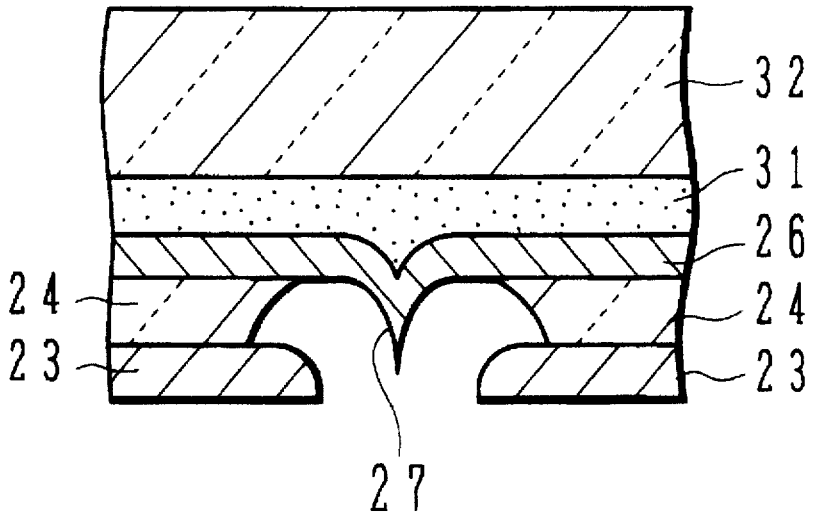
FIGS. 4 to 7 are cross sectional views showing the structures of field emission type elements according to other embodiments of the invention.
Figure 5:
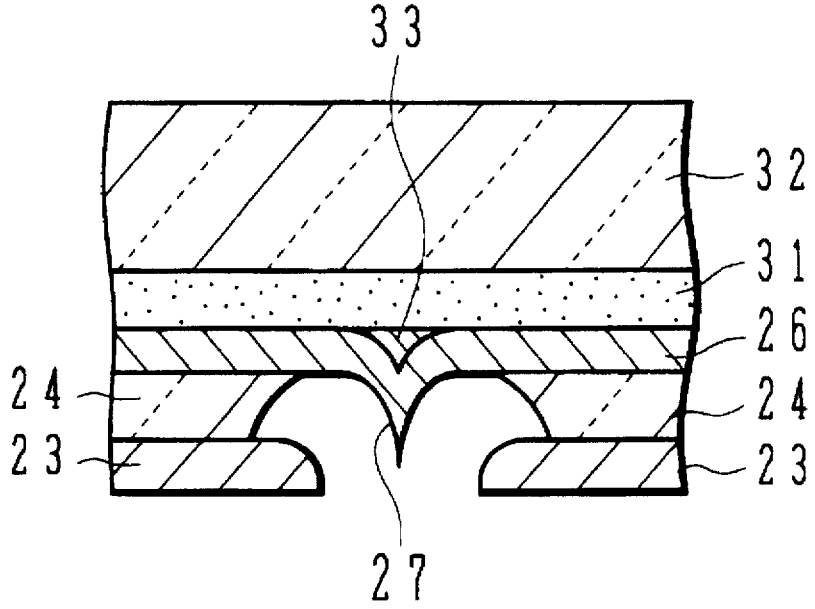

As shown in FIG. 4, it is preferable, for example to bond a support substrate 32 on the emitter electrode material film 26 with adhesive 31 such as epoxy resin or glass of a low melting point. In this case, a void may be formed if a cusp on the back (upper) surface of the field emission emitter is not completely filled with the adhesive. In order to avoid this, as shown in FIG. 5, a film 33 such as an SOG (spin-on-glass) film may be coated and etched back or subjected to CMP (chemical mechanical polishing) to planarize the surface thereof.

Figure 6:
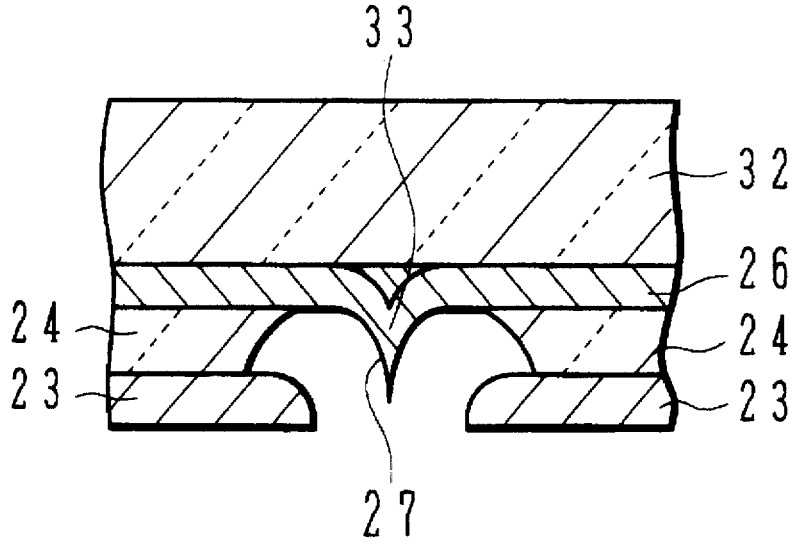

As shown in FIG. 6, if the field emission emitter has a planarized back surface, a support substrate 32 may be directly bonded by electrostatic bonding without using adhesive. Direct bonding eliminates a possible problem of causing a low vacuum by the element due to release of gas (out-gas) contained in epoxy resin and a problem of a short circuit of wiring due to diffusion of Pb components contained in adhesive glass of a low melting point.

Figure 7:
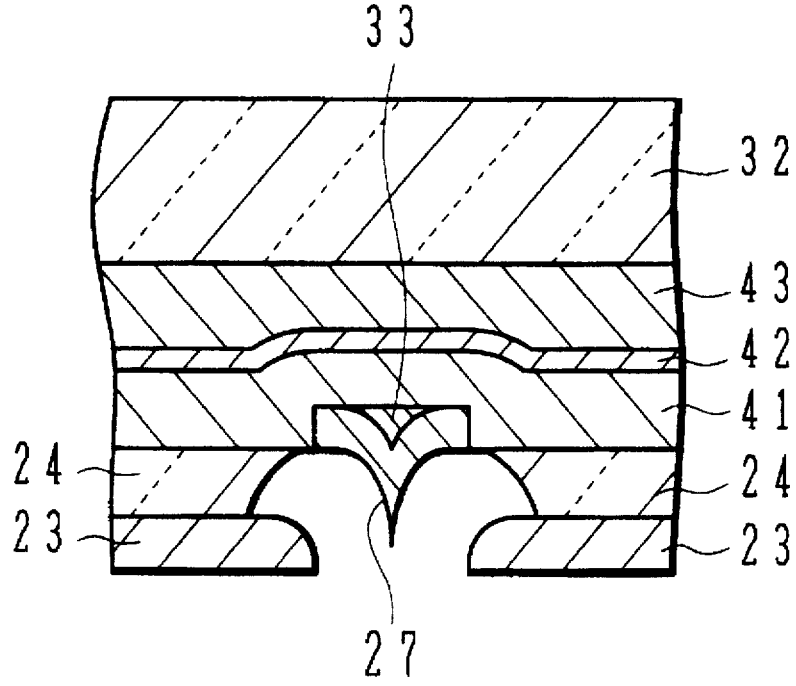

In another embodiment shown in FIG. 7, an emitter electrode material film 26 may be removed while leaving only a field emission emitter 27 and a resistor layer 41 of amorphous Si, polysilicon, or the like is formed over the substrate surface. If a wiring layer 43 of metal such as Al, Cu, and Cr or alloy such as AlSiCu and AlCu is formed directly on the resistor layer 41 made of Si, mutual diffusion occurs. This mutual diffusion changes (lowers) the resistance of the Si resistor layer and may lose the essential function as a resistor. In order to prevent this mutual diffusion, a barrier layer 42 is formed on which an emitter wiring layer 43 is formed. The barrier layer 42 may be a TiN layer, a TiON layer, a TiW layer, a Ti layer, a W layer, or the like, or a laminate thereof. On this wiring layer 43 a support substrate 32 is bonded.

In the above embodiments, a field emission type element having only one field emission emitter has been described. If a number of gate openings are formed on the substrate for forming emitter molds, a field emitter array (FEA) having a number of emitters can be manufactured. For example, refer to U.S. Ser. Nos. 08/540,418, 08/544,922 (now U.S. Pat. No. 5,599,749), and 08/564,604 which are herein incorporated by reference.

In addition to a point-type field emission emitter with a circular gate opening in plan view, a wedge-type field emission emitter with a rectangular gate opening in plan view may also be manufactured.

The present invention has been described in connection with the preferred embodiments. The invention is not limited only to the above embodiments. It is apparent to those skilled in the art that various modifications, improvements, combinations and the like can be made.

I claim:

1. A method of manufacturing a field emission type element comprising the steps of:

forming a first recess having a vertical or generally vertical side wall in a surface layer of a substrate;

forming a gate electrode material film on the substrate, thereby covering the first recess;

reacting the gate electrode material film with an oxidizing or nitriding agent to leave the gate electrode material film intact only outside of the first recess and form an insulating film having a second recess with a sharp edge over the first recess;

forming an emitter electrode material film on the insulating film to fill the second recess with a field emission emitter; and removing the insulating film around the field emission emitter.

2. A method according to claim 1, wherein said step of forming a gate electrode material film comprises a film deposition process that promotes formation of a partially inverted taper area over the first recess.

3. A method according to claim 1, wherein the gate electrode material film is made of silicon.

4. A method according to claim 1, wherein said step of reacting the gate electrode material film includes one process selected from the group consisting of wet oxidation, dry oxidation, plasma oxidation, thermal nitridation, plasma nitridation, ammonia nitridation, ammonia plasma and fluorine nitridation and optical nitridation with an excimer laser.

5. A method according to claim 1, wherein the emitter electrode material film includes a TiN film.

6. A method according to claim 1, wherein the emitter electrode material film includes a TiN/W/Al laminate film.

7. A method of manufacturing an electron emission device, comprising the steps of:

(a) providing a substrate having a surface layer, wherein a hole is provided in the surface layer to define a horizontal surface and a vertical surface in the surface layer;

(b) providing a sacrificial layer over the horizontal surface and the vertical surface;

(c) converting a part of the sacrificial layer in a reactive ambient in such a manner that volume of the sacrificial layer increases so that a cusp shape is formed in the hole, wherein unconverted sacrificial layer remains only on the horizontal surface of the surface layer;

(d) providing an electron emitting material layer over the substrate;

(e) forming an access hole in the electron emitting material layer; and (f) selectively removing the sacrificial layer and the surface layer through the access hole.

8. A method according to claim 7, wherein the sacrificial layer comprises a material selected from a group consisting of amorphous silicon and polycrystalline silicon.

9. A method according to claim 7, wherein the electron emitting material layer is made of TiN.

10. A method according to claim 7, wherein the reactive ambient includes oxygen to oxidize the sacrificial layer.

11. A method according to claim 7, wherein the reactive ambient includes nitrogen to nitride the sacrificial layer.

12. A method according to claim 7, wherein the unconverted sacrificial layer remaining only on the horizontal surface of the surface layer serves as a gate structure of the electron emission device.

13. A method of manufacturing an electron emission device, comprising the steps of:

(a) providing a substrate having a surface layer, wherein a hole is provided in the surface layer to define a horizontal surface and a vertical surface in the surface layer;

(b) providing a conductive sacrificial layer over the horizontal surface and the vertical surface;

(c) converting a part of the conductive sacrificial layer into an insulating sacrificial layer in a reactive ambient in such a manner that volume of the conductive sacrificial layer increases so that a cusp shape is formed in the hole, wherein conductive sacrificial layer remains only on the horizontal surface of the surface layer;

(d) providing an electron emitting material layer over the substrate;

(e) forming an access hole in the electron emitting material layer; and (f) selectively removing the insulating sacrificial layer and the surface layer through the access hole.

* * * * *